US011353198B2

(12) United States Patent
Keswani et al.

(10) Patent No.: US 11,353,198 B2
(45) Date of Patent: Jun. 7, 2022

(54) ELECTRICAL CONNECTOR HAVING A PRINTED CIRCUIT BOARD FOR USE WITH AN ACTIVE GRID BUS BAR SYSTEM

(71) Applicant: IDEAL Industries, Inc., Sycamore, IL (US)

(72) Inventors: Sushil N. Keswani, Sycamore, IL (US); Timothy B. Tunnell, Sycamore, IL (US); Adam James Tammisto, DeKalb, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 1395 days.

(21) Appl. No.: 15/485,725

(22) Filed: Apr. 12, 2017

(65) Prior Publication Data

US 2017/0338572 A1 Nov. 23, 2017

Related U.S. Application Data

(63) Continuation-in-part of application No. 14/226,017, filed on Mar. 26, 2014, now Pat. No. 9,627,928, and (Continued)

(51) Int. Cl.

| | |
|---|---|
| ***F21V 21/088*** | (2006.01) |
| ***H01R 25/16*** | (2006.01) |
| ***H01R 25/14*** | (2006.01) |

(52) U.S. Cl.

CPC ..... *F21V 21/088* (2013.01); *H01R 25/147* (2013.01); *H01R 25/162* (2013.01)

(58) Field of Classification Search

CPC .. G01N 33/0062; H05B 47/19; H01R 25/162; H01R 25/147; H01R 25/142;

(Continued)

(56) References Cited

U.S. PATENT DOCUMENTS

| | | | | |
|---|---|---|---|---|
| 6,246,182 | B1 * | 6/2001 | Yamasaki | H05B 39/00 315/209 R |
| 7,997,910 | B2 | 8/2011 | Myers et al. | |

(Continued)

FOREIGN PATENT DOCUMENTS

| | | | |
|---|---|---|---|
| CN | 104160564 | A | 11/2014 |
| CN | 104704590 | A | 6/2015 |
| WO | 2013/130432 | A1 | 9/2013 |

OTHER PUBLICATIONS

Wikipedia contributors. "Printed circuit board." Wikipedia, The Free Encyclopedia. Wikipedia, The Free Encyclopedia, Jul. 21, 2020. Web. Jul. 28, 2020. (Year: 2020).*

(Continued)

*Primary Examiner* — Daniel Cavallari

(74) *Attorney, Agent, or Firm* — Greenberg Traurig, LLP

(57) ABSTRACT

A connector for use in coupling a load device to electrical conductors of a direct current bus bar. The connector has a housing and the housing carrying a printed circuit board that is electrically coupled to the bus bar and the load device. The printed circuit board functions to control the providing of direct current power from the bus bar to the load device, provide a dimming signal to the load device, and/or selectively provide direct current from a source of emergency power to the load device.

22 Claims, 10 Drawing Sheets

Related U.S. Application Data a continuation-in-part of application No. 13/650,757, filed on Oct. 12, 2012, now Pat. No. 9,660,447, said application No. 14/226,017 is a continuation-in-part of application No. 13/591,371, filed on Aug. 22, 2012, now abandoned.

(60) Provisional application No. 62/325,827, filed on Apr. 21, 2016, provisional application No. 61/812,548, filed on Apr. 16, 2013, provisional application No. 61/812,070, filed on Apr. 15, 2013, provisional application No. 61/606,129, filed on Mar. 2, 2012.

(58) Field of Classification Search
CPC .... H01R 13/6658; H02J 9/00; Y10T 307/944; Y10T 307/74; Y02B 90/228; Y02B 70/3283; Y02B 90/226; Y04S 20/16; Y04S 20/18; Y04S 20/246
See application file for complete search history.

(56) References Cited

U.S. PATENT DOCUMENTS 8,062,042 B2 11/2011 Patterson et al.
8,770,993 B2 * 7/2014 Gingrich, III ..... H01R 25/142 439/121
8,986,021 B2 3/2015 Keswani
9,190,790 B1 11/2015 Gongora et al.
9,644,828 B1 * 5/2017 May ..... F21K 9/275
2003/0001506 A1 1/2003 Joel et al.
2005/0169015 A1 * 8/2005 Luk ..... F21V 3/00 362/648
2005/0243549 A1 * 11/2005 Ruston ..... H05B 47/155 362/233
2007/0291433 A1 12/2007 Ziegler et al.
2008/0001551 A1 1/2008 Abbondanzio et al.
2012/0007516 A1 * 1/2012 Lax ..... F21V 31/005 315/201
2013/0323950 A1 * 12/2013 Gingrich, III ..... H01R 25/142 439/215
2014/0217906 A1 * 8/2014 Vo ..... H05B 47/195 315/155
2014/0308828 A1 10/2014 Ehlen
2015/0092449 A1 4/2015 Demuynck et al.
2015/0137683 A1 * 5/2015 Krames ..... F21V 23/008 315/113

OTHER PUBLICATIONS

CNIPA, office action issued on Chinese patent application No. 201710261453.3, 5 pages.
European Patent Office, extended European search report issued on European patent application 17000694.4, dated Mar. 8, 2018, 11 pages.
CNIPA, office action issued on Chinese patent application No. 201710261453.3, 11 pages.
European Patent Office, office action issued on European patent application No. 17000694.4, dated Apr. 12, 2021, 4 pages.

* cited by examiner

ELECTRICAL CONNECTOR HAVING A PRINTED CIRCUIT BOARD FOR USE WITH AN ACTIVE GRID BUS BAR SYSTEM

RELATED APPLICATION INFORMATION

The subject application claims the benefit of U.S. Provisional Application No. 62/325,827, filed on Apr. 21, 2016.

The subject application also claims the benefit of and is a continuation-in-part of U.S. application Ser. No. 13/650,757, filed on Oct. 12, 2012.

The subject application also claims the benefit of and is a continuation-in-part of U.S. application Ser. No. 14/226,017, filed on Mar. 26, 2014. U.S. application Ser. No. 14/226,017 claims the benefit of U.S. Provisional Application No. 61/812,070, filed Apr. 15, 2013 and U.S. Provisional Application No. 61/812,548, filed Apr. 16, 2013. U.S. application Ser. No. 14/226,017 also claims the benefit of and is a continuation-in-part of U.S. application Ser. No. 13/591,371, filed Aug. 22, 2012, which application claims the benefit of U.S. Provisional Application No. 61/606,129 filed on Mar. 2, 2012.

All of these applications are incorporated herein by reference in their entirety.

FIELD OF THE DISCLOSURE

The subject disclosure relates generally to electrical connectors, and more particularly to an electrical connector having a printed circuit board for use with an active grid bus bar system.

BACKGROUND OF RELATED ART

Bus bar systems and electrical connectors for use in coupling devices to a bus bar system are generally known in the art.

By way of example, U.S. Pat. No. 8,062,042 describes an electrified, framework system for bringing power and/or signals to devices. The electrified, framework system includes at least one longitudinally extending, electrified bus bar. The bus bar has a housing which includes a pair of conductors positioned thereon. Each conductor has a surface which provides a continuous conductive path for attachment of devices. Meanwhile, U.S. Pat. No. 7,997,910 describes connectors for use with the electrified, framework system described in the '042 patent. In particular, the '910 patent describes an electrical connector for coupling the electrical connections of the bus bar to a source device, such as a power supply, and/or a connector for coupling the electrical conductors of the bus bar to a sink device, such as a lamp.

In addition, U.S. Pat. No. 8,986,021 discloses an electrical connector that includes a non-electrically-conductive housing carrying at least a pair of opposed flexible, electrically-conductive push-in type contacts. The contacts each having a first end configured to receive and grip an electrical conductor, and a second end having a contact portion to releasable electrically couple with a corresponding conductive strip housed on opposite sides of an upper rail of a corresponding low voltage direct current grid member. A strain relief mechanism is coupled to the housing and is adapted to mechanically couple to the inserted electrical conductor and to assist in retaining the inserted electrical conductor in the push-in type contact.

Similarly, U.S. Pat. No. 9,190,790 discloses a connector including a first housing section carrying a first conductor element and a second housing section carrying a second conductor element. The first housing section and the second housing section are coupled to each other about a pivot axis such that the first housing section and the second housing section are moveable relative to each other. The first housing section and the second housing section are intended to be moved from a first position to a second position in which the first conductor element of the first housing section and the second conductor element of the second housing section are positioned to make contact with the electrical conductors of a bus bar. In the second position the first housing section and the second housing section are further adapted to engage with each other to thereby inhibit the first housing section and the second housing section from being moved relative to each other back towards the first position.

While the devices described in these publications, which publications are incorporated herein by reference in their entirety, generally work for their intended purpose, the following describes an improved connector for use with a bus bar system.

SUMMARY

Described hereinafter is an improved connector having a multi-use printed circuit board for use in connection with a bus bar system.

While the foregoing provides a general description of the subject device, a better understanding of the objects, advantages, features, properties and relationships of the subject device and system will be obtained from the following detailed description and accompanying drawings which set forth illustrative embodiments and which are indicative of the various ways in which the principles of the hereinafter claimed invention may be employed.

BRIEF DESCRIPTION OF THE DRAWINGS

For a better understanding of the subject connector, reference may be had to the following drawings.

DETAILED DESCRIPTION

Figure 2:
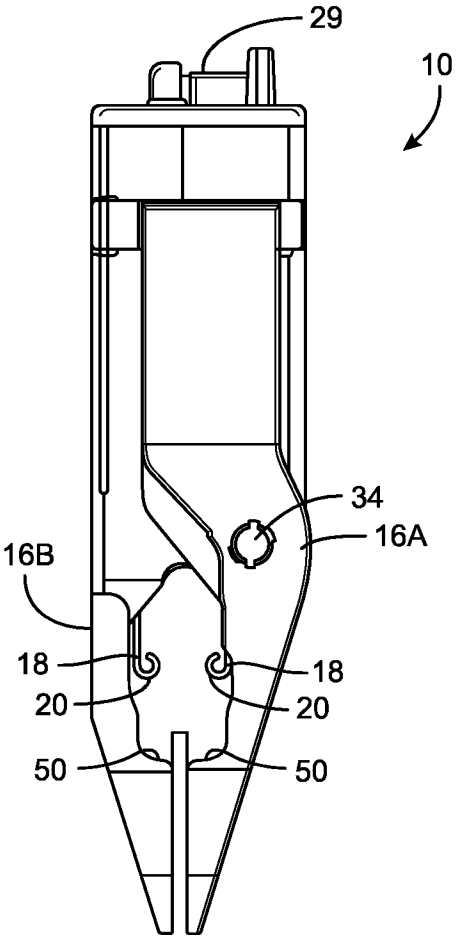
FIG. 2 illustrates a side elevational view of the example connector of FIG. 1.
Figure 1:
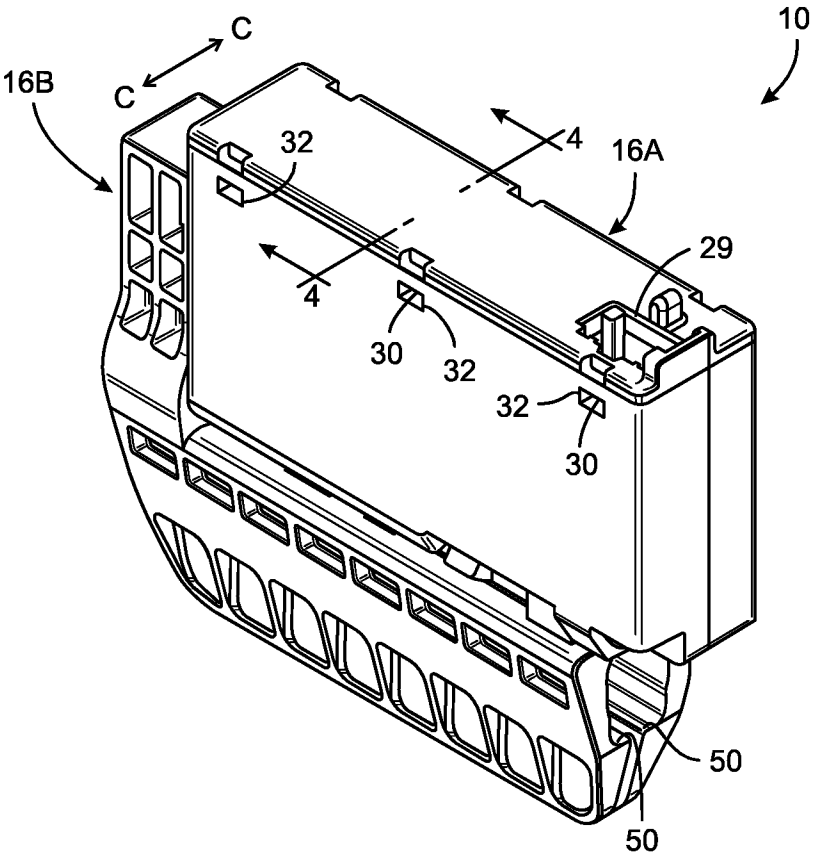
FIG. 1 illustrates an example connector constructed according to the description.
Figure 3:
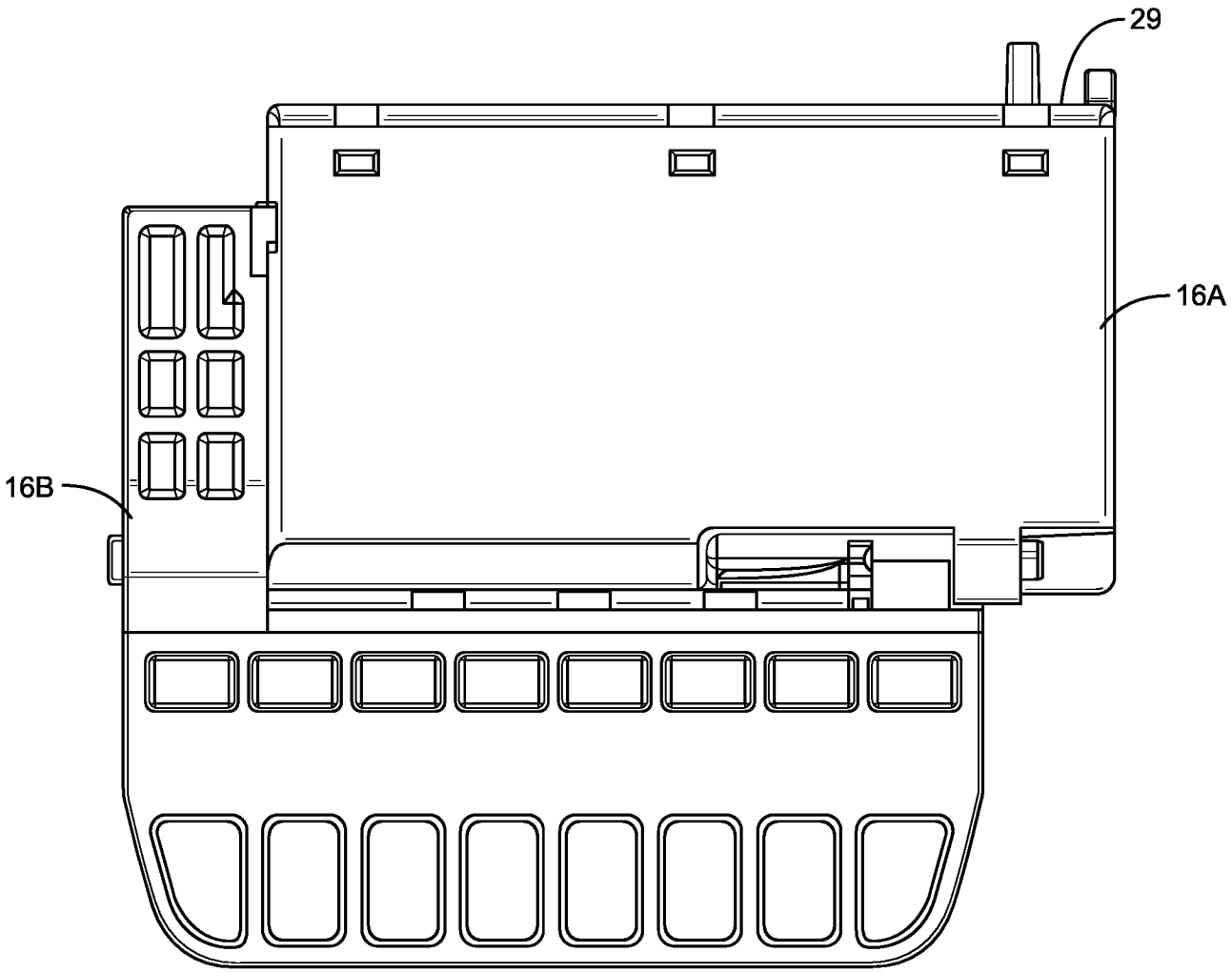
FIG. 3 illustrates a front elevational view of the example connector of FIG. 1.
Figure 5:
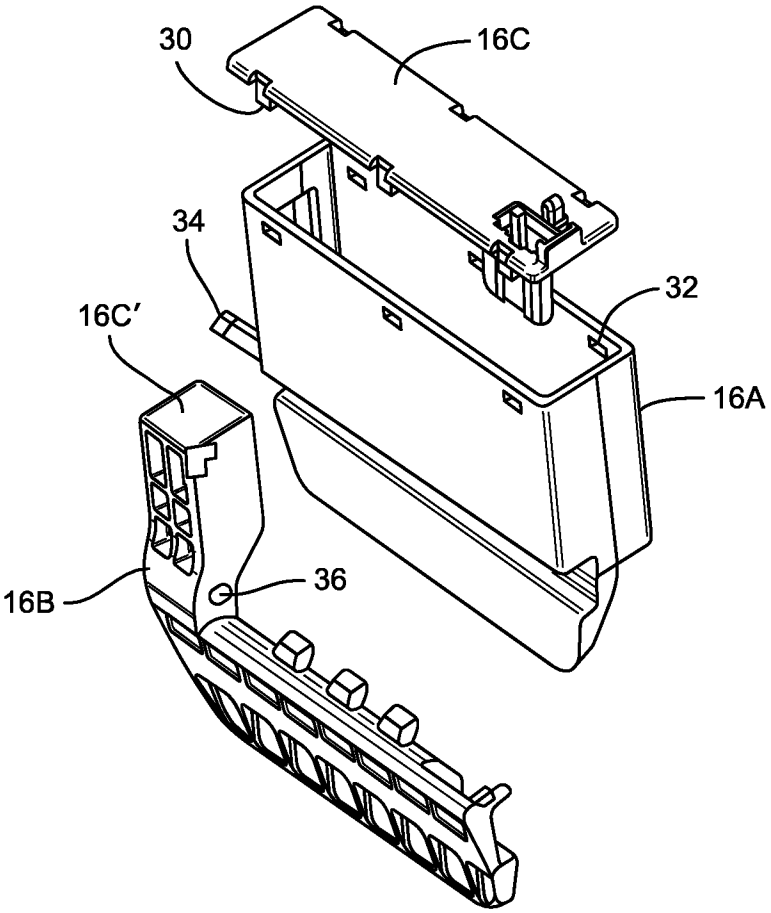
FIG. 5 illustrates an exploded component view of the housing of the example connector of FIG. 1.
Figure 4:
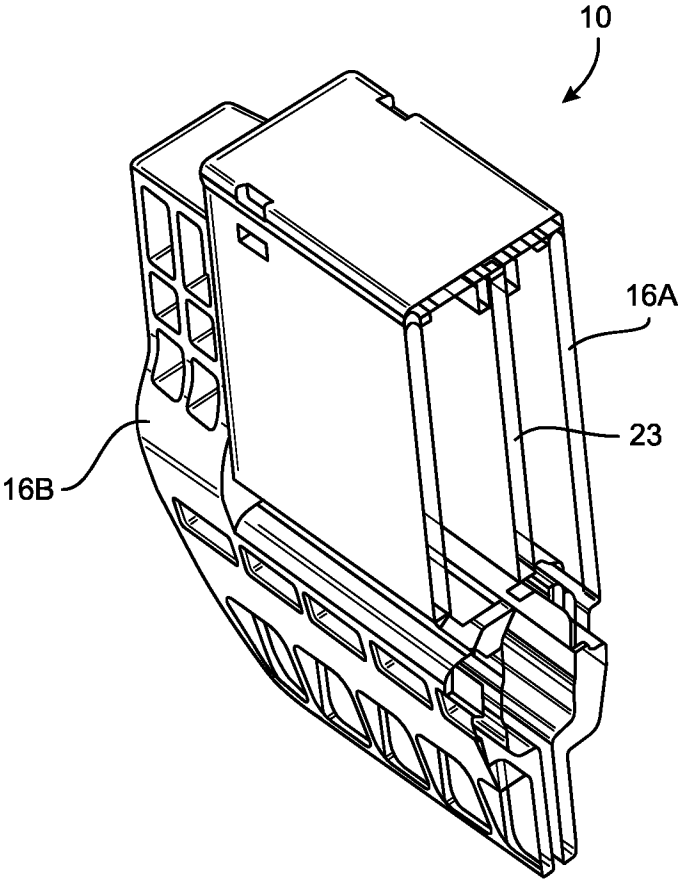
FIG. 4 illustrates a cross-sectional view of the example connector along line 4-4 of FIG. 1.
Figure 6:
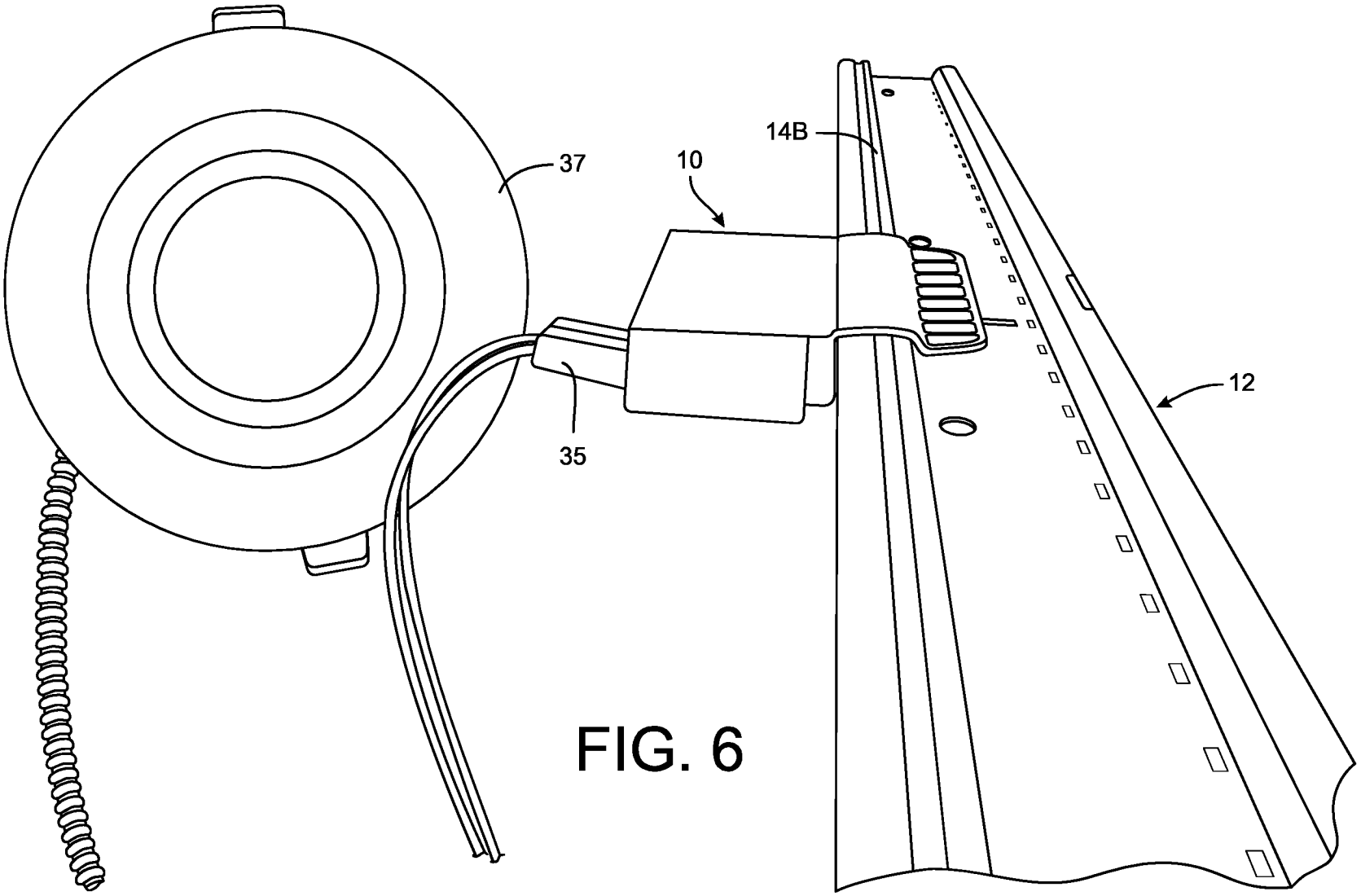
FIG. 6 illustrates the example connector of FIG. 1 as coupled to an example bus bar.
Figure 7:
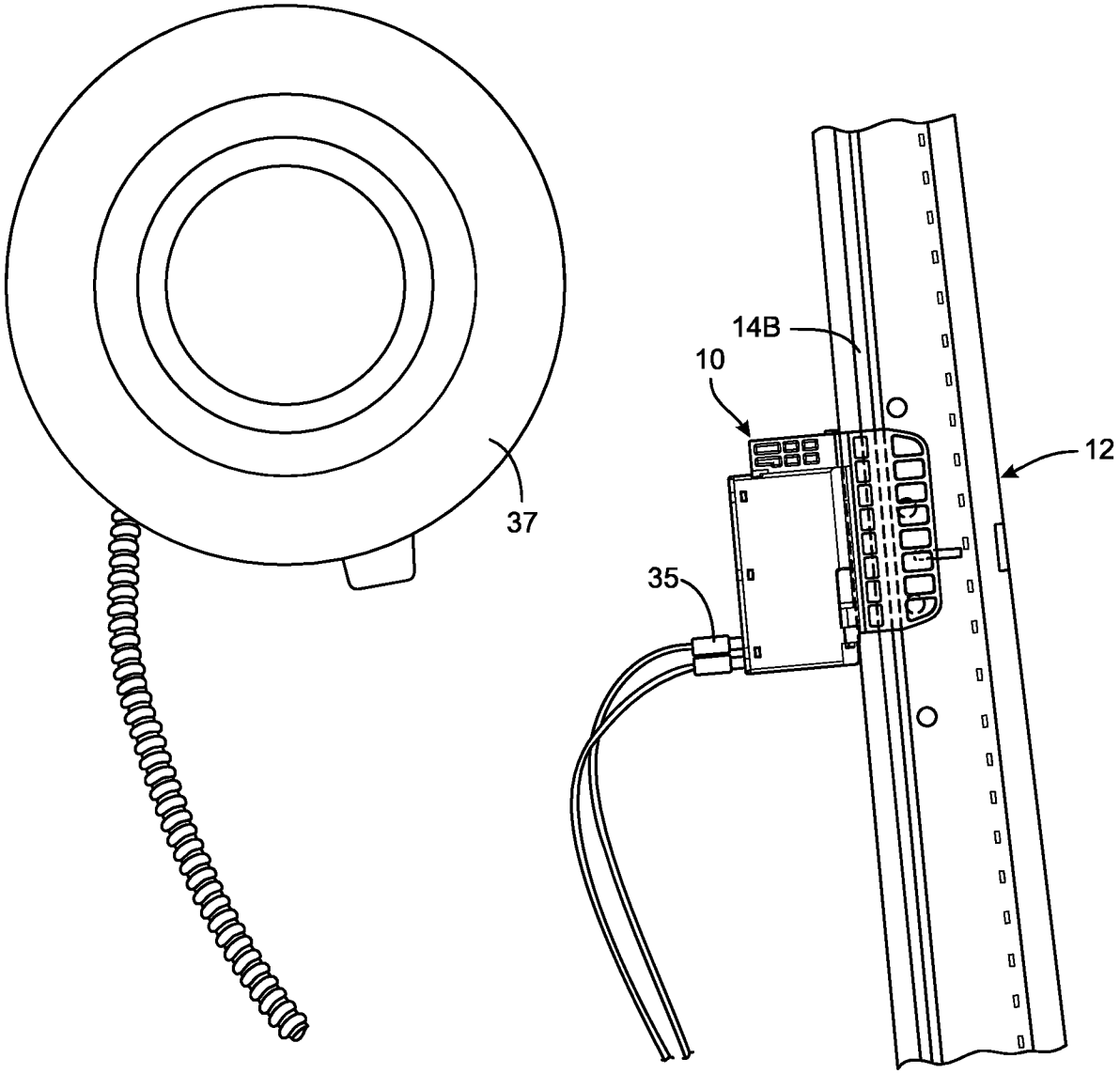
FIG. 7 illustrates another view of the example connector of FIG. 1 as coupled to the example bus bar.
Figure 8:
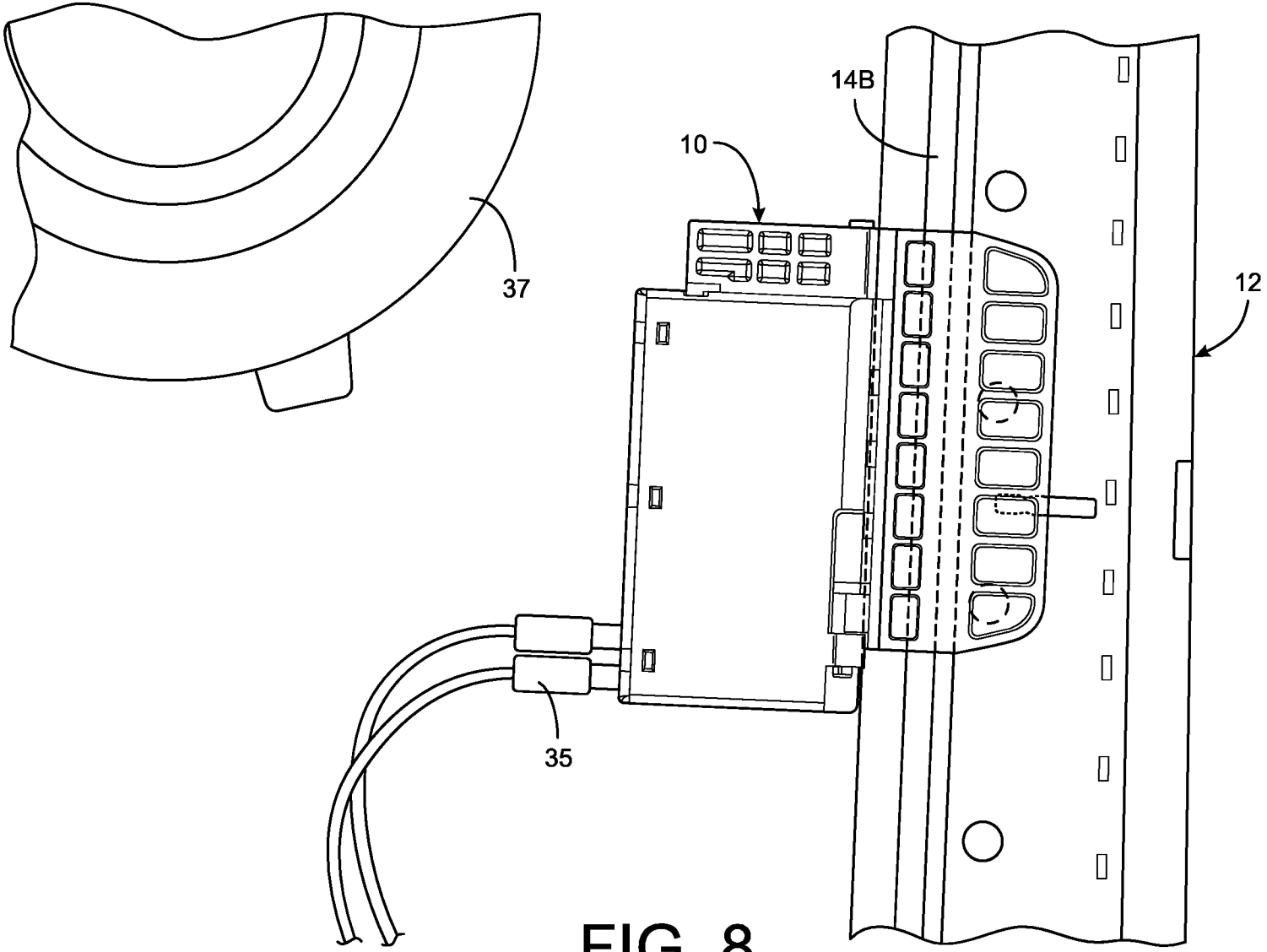
FIG. 8 illustrates another view of the example connector of FIG. 1 as coupled to the example bus bar.
Figure 9:
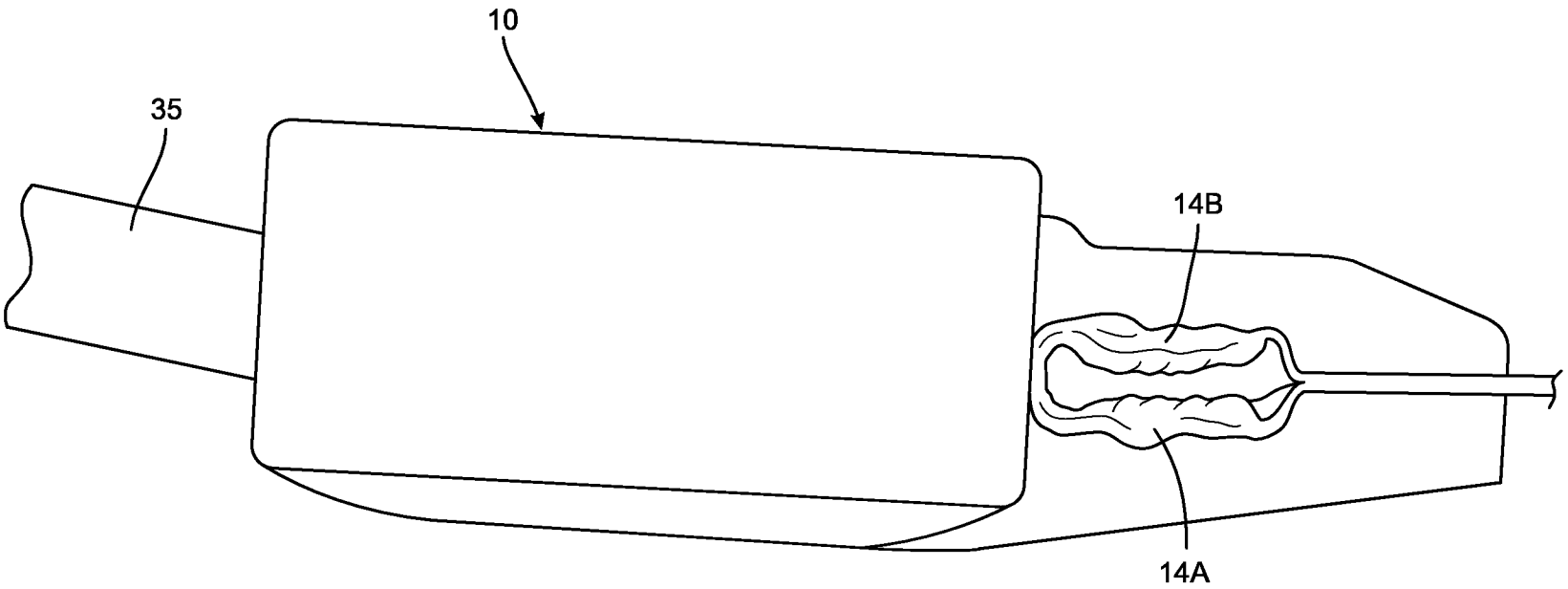
FIG. 9 illustrates yet another view of the example connector of FIG. 1 as coupled to the example bus bar.

The following description of example methods and apparatuses are not intended to limit the scope of the invention hereinafter claimed to the precise form or forms detailed herein. Instead the following description is intended to be illustrative so that others may follow its teachings.

With reference to the figures, wherein like reference numerals refer to like elements, a connector 10 for use in electrically coupling a device, such as a power source device or a power sink device, to a bus bar will now be described. As particularly shown in FIGS. 6-9, the exemplary connector 10 is especially adapted for use with a bus bar 12 of the type described in U.S. Pat. Nos. 8,062,042 and 7,997,910, i.e., a bus bar having a top portion where one side surface of the top portion carries a first conductive strip 14A and the opposite side surface of the top portion carries a second conductive strip 14B and wherein the first conductive strip 14A and the second conductive strip 14B have opposite polarities. In certain circumstances, the bottom portion of the bus bar may also be provided with conductive elements for providing direct current (DC power). While FIGS. 6-9 illustrate the connector 10 being usable with a bus bar 12 of the noted type, it is to be understood that the hereinafter described connector 10 can be provided with other shapes, sizes, and/or arrangements as needed to thereby allow the connector 10 to be usable with other types of bus bars. Accordingly, the exemplary use environment that is illustrated in FIGS. 6-9 is not intended to be limiting.

As shown in FIGS. 1-5, for securely coupling the connector 10 to the bus bar 12, the connector 10 is provided with a pair of pivotally connected and optionally lockable electrical conductor housing elements 16A and 16B. A cap 16C, 16C' may optionally be provided on at least one of the housings 16A, 16B if desired, but it will be appreciated that the housings 16A, 16B may be integrally formed without the cap 16C, 16C' as desired. For electrically coupling the connector 10 to the bus bar 12, each of the housing elements 16A and 16B carries an electrical conductor 18 having a first end 20 and a second end (not shown). The first end 20 of each electrical conductor 18 is arranged in its housing element 16A and 16B such that the first end of each of the electrical conductors 18 will be placed into engagement with a corresponding one of the conductive strips 14A and 14B when the connector 10 is, in turn, coupled to the bus bar 12. In this regard, and as will be described in greater detail hereinafter, when the housing elements 16A and 16B are pivoted into position and locked to the bus bar 12, the cooperating housing elements 16A and 16B will function to drive the first end 20 of each conductor 18 into a corresponding one of the conductive strips 14A and 14B. Meanwhile, the second end of the electrical conductor 18 is arranged to be operatively coupled directly or indirectly to at least one of a printed circuit board 23 (PCB 23), or an external electrical conductor, such as a wire from a sink or source device. In the illustrated example, the conductors 18 are directly coupled to the PCB 23 at the second end as in any suitable manner as is known to one of ordinary skill in the art. As additionally illustrated in the figures, the housing elements 16A and 16B may be provided with bus bar engaging surfaces 50 for preventing the connector 10 from being lifted off of the bus bar 12.

Figure 11:
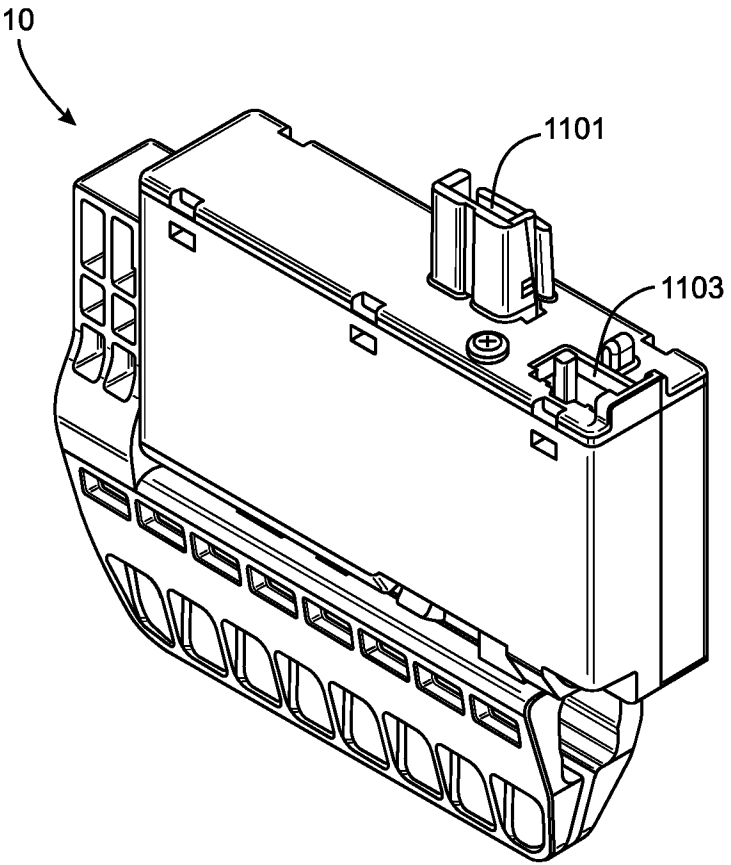
FIG. 11 illustrates a still further example connector.
Figure 10:
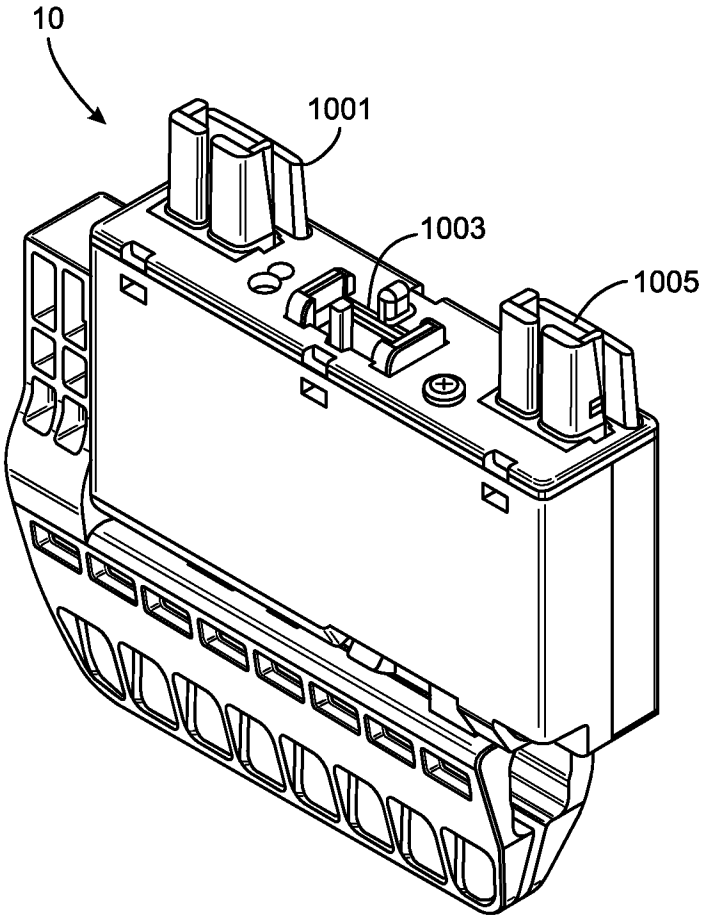
FIG. 10 illustrates a further example connector.

In the illustrated example, the second housing section 16A is enlarged and/or otherwise elongated and sized (particularly relative to first housing section 16B) to house the PCB 23 (see FIG. 4) and the PCB 23 is electrically coupled to the electrical conductors 18. The PCB 23, in turn, includes relevant circuitry, including for instance power control, dimming control, transceiver capabilities, emergency power switching control, etc. The PCB 23 further includes, or is coupled to, at least one terminal for coupling to an external conductor, such as a wire, where the external conductor is fed through, or the terminal placed in, an aperture 29 formed by, in this example, the housing 16A. Preferably, the PCB 23 is coupled to terminals in an amount sufficient to allow the PCB 23 to be coupled to an emergency power source 1201, the DC power grid bus power source 1203, and a load device 1205, such as a LED light fixture, as particularly illustrated in FIG. 12. Thus, for example, the housing may be provided with terminals (or apertures leading to terminals) as required to allow the PCB 23 to be coupled to the relevant electrical components as illustrated in FIGS. 10 and 11 in which the housing is illustrated as be provided with a terminal 1001 for allowing conductor(s) that function to provide a pulse width modulated ("PWM") signal for the load to be coupled to the PCB 23, a terminal 1003 for allowing conductor(s) that output a PWM signal for the load (or full power in the case when the PWM is lost) to be coupled to the PCB 23, a terminal 1005 for allowing conductor(s) that function to provide DC emergency power to be coupled to the PCB 23, a terminal 1101 for allowing conductor(s) that function to provide power, e.g., ON/OFF, to the load to be coupled to the PCB 23, and/or a terminal 1103 for allowing conductor(s) that function to provide dimming control signals, e.g., 0-10 dimming, to the load to be coupled to the PCB 23. As will be appreciated, terminals 1101 provides a load-side power interface while terminals 1103 and/or 1003 provide a load-side control interface while electrical conductors 18 provide a line-side power interface.

In an exemplary embodiment, the aperture 29 shown in FIGS. 6-9 is sized and configured to accept a push-in type electrical connector 35, such as a "POWERPLUG® Luminaire Disconnects -180 Series" available from IDEAL INDUSTRIES, INC., or other electrical device. It will be appreciated that other types of wire connection terminations may also be used for this purpose, such as crimp type terminations, solder type terminations, or the like without limitation. In this manner, when the conductor 10 is installed on the bus bar 12, the electrical conductors 18 can function to provide an electrical coupling between wires of a device 37 (as coupled to the PCB 23 and/or the second end of the electrical conductors 18) and the conductive strips 14A and 14B of the bus bar 12 (as coupled to the first end 20 of the electrical conductors 18). In a preferred embodiment, the housing elements 16A and 16B are identically constructed and formed from an electrically insulating material while the electrical conductors 18 are formed using a resilient, electrically conductive material. The PCB 23 may also allow specialized control of the power and/or signal delivered to the device 37, such as for instance a pulse-width modulation (PWM) dimming signal, a 0-10 diming signal, Digital Addressable Lighting Interface (DALI) protocol signal, or the like without limitation.

In this example, to maintain the electrical contacts 18 within the housing elements 16A, the housing elements 16A is provided with the cap 29. As previously noted, the cap 16C defines an aperture 29, for receiving an electrical connector or an electrical conductor as desired. In the illustrated example, the cap 16C is provided with a pair of locking elements 30, e.g., one of a tang or a slot, while the housing element 16A is provided with a pair of cooperating locking elements 32, e.g., the other of a tang or a slot, to thereby allow the cap 16A to be snap fit into engagement with the housing element 16A and to thereby support the PCB 23 and the electrical contacts 18 from the top while locking the PCB 23 and the electrical contacts 18 in position within the housing element 16A. Other locking type elements can also be used for this purpose and/or the cap 16C can be secured to the housing element 16A via use of other known methods such as welding, gluing, or the like.

For pivotally coupling the housing sections 16A and 16B to each other, the housing sections 16A and 16B are each provided with a pivot post 34 and a pivot post receiving opening 36 that is axially aligned with the pivot post 34. The pivot posts 34 is preferably integrally formed with its respective housing section 16A and 16B, but can be a separate element attached thereto as desired. As will be appreciated, the pivot post 34 of the housing section 16A is intended to be received in the pivot post receiving opening 36 of the housing section 16B.

Once pivotally assembled, in operation the connector 10, and more particularly housing sections 16A and 16B, are squeezed together (i.e., are moved in the direction shown by the lines C of FIG. 1) such that the pivot posts 34 of the housing sections 16A and 16B are moved into the pivot post receiving openings 36 of the opposite one of the housing sections 16A and 16B. As such, the housing sections 16A, 16B may be biased into a closed position by any suitable means, including an external biasing member (e.g., a spring) or via construction shape of the housing and/or pivot posts 34.

Once the connector 10 is positioned upon the bus bar 12, the connector 10 can be locked to the bus bar 12 by rotating the housing sections 16A and 16B towards one another in the direction of the arrow C-C.

Figure 12:
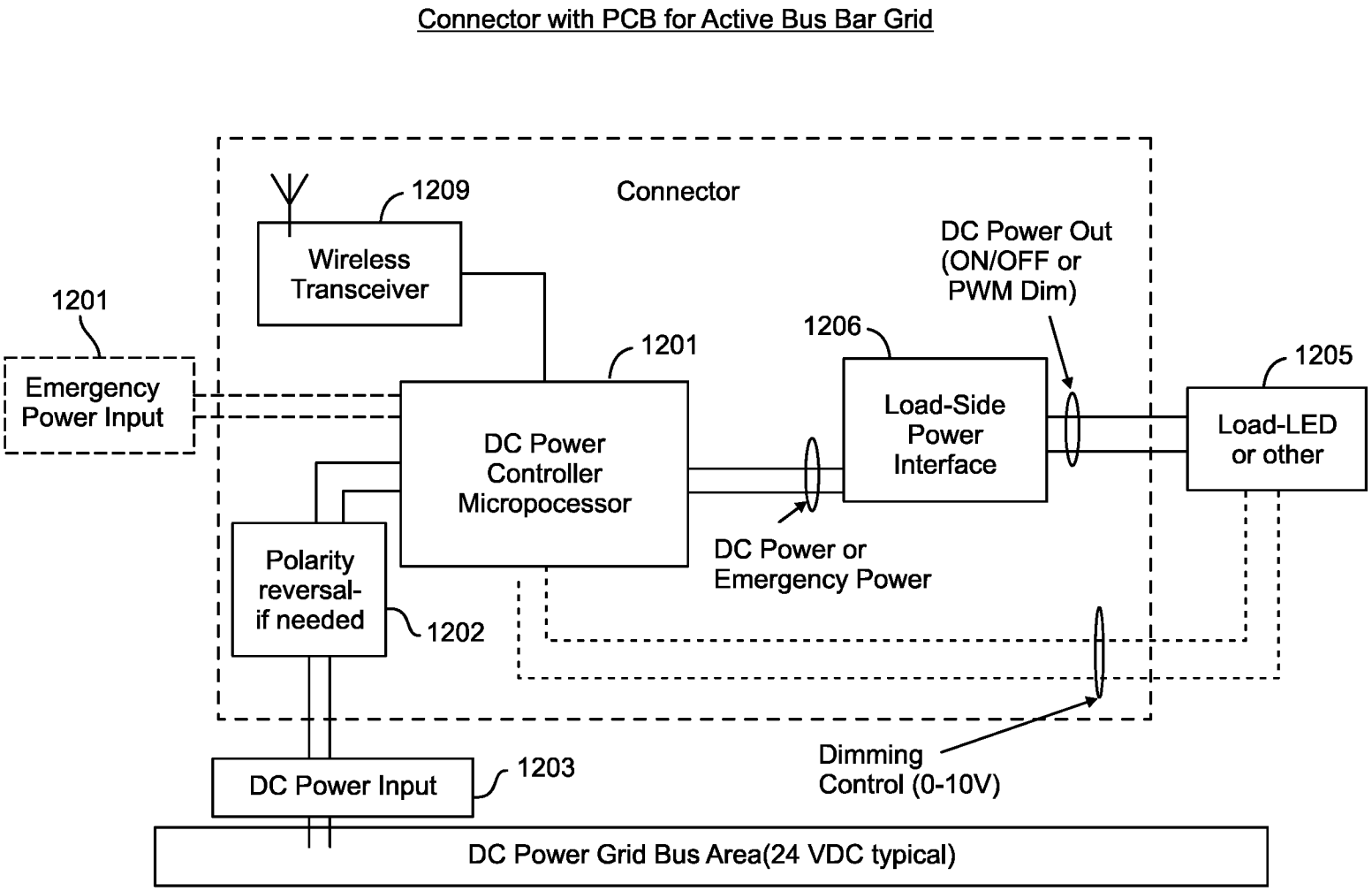
FIG. 12 illustrates a block diagram of example PCB components for use with the example connectors.

As further illustrated in FIG. 12, the exemplary connector 10 includes a processing device 1201 which is electrically coupled to a DC power grid bus via use of a polarity reversing circuit 1202 (as needed). The DC power grid bus functions to provide DC power to the exemplary connector 10. The exemplary connector 10 is further electrically coupled to a load device 1205 via use of a load-side power interface 1206. As illustrated, the load-side power interface 1206 functions to provide DC power to the load device 1205, which DC power may be on/off power and/or PWM dimmed power. In some circumstances, the processing device 1201 may also function to provide a dimming control signal, e.g., a 0-10 dimming control signal, to the load device 1205. While not required, the exemplary connector 10 may also be electrically coupled to an emergency power input 1201. Thus, in instances where the connector 10 determines that power from the DC power grid is lost, the connector 10 may function to provide power from the emergency power input 1201 to the load device, preferably to turn the load device 1205 full on. Yet further, the example connector 10 may include a wireless transceiver 1209 wherein the wireless transceiver is used to provide a control signal—received from a further device—to the processing device 1201 for use in controlling operations of the connector 10, e.g., to control power on/off, to control dimming, etc. It will also be appreciated that, in the case when a transceiver 1209 is utilized, the connector 10 may allow for state data associated with the connector 10, and accordingly the device 1205, and/or other data to be communicated to other remotely located devices as needed.

Figure 14:
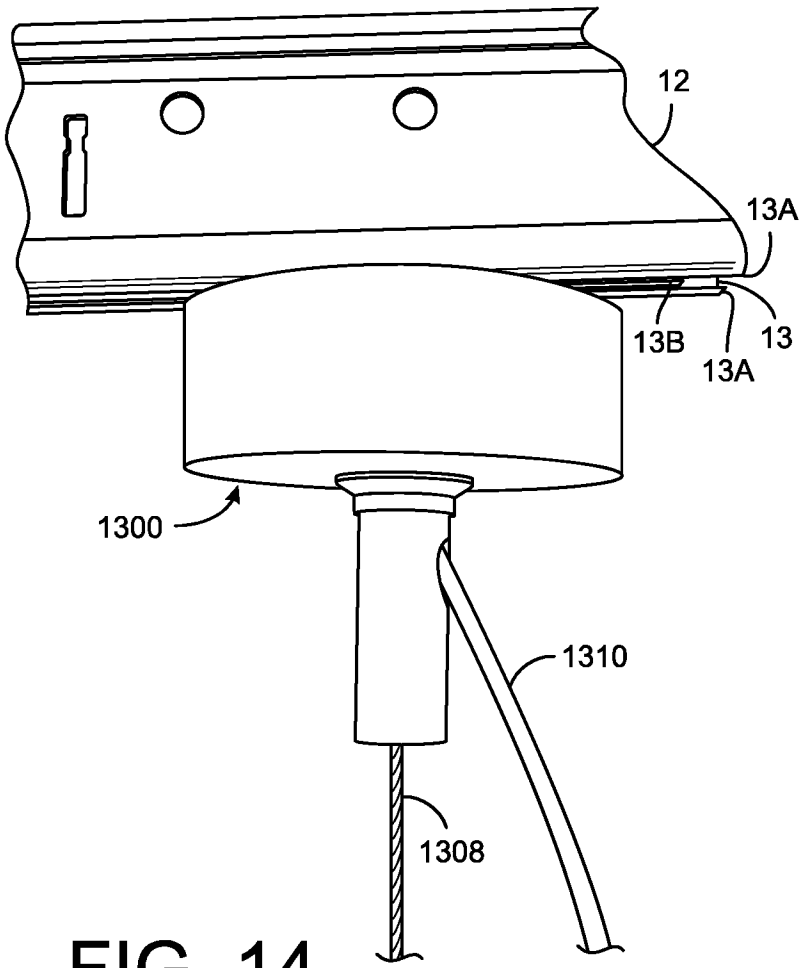
FIG. 14 illustrates the connector of FIG. 13 as coupled to the example bus bar.
Figure 13:
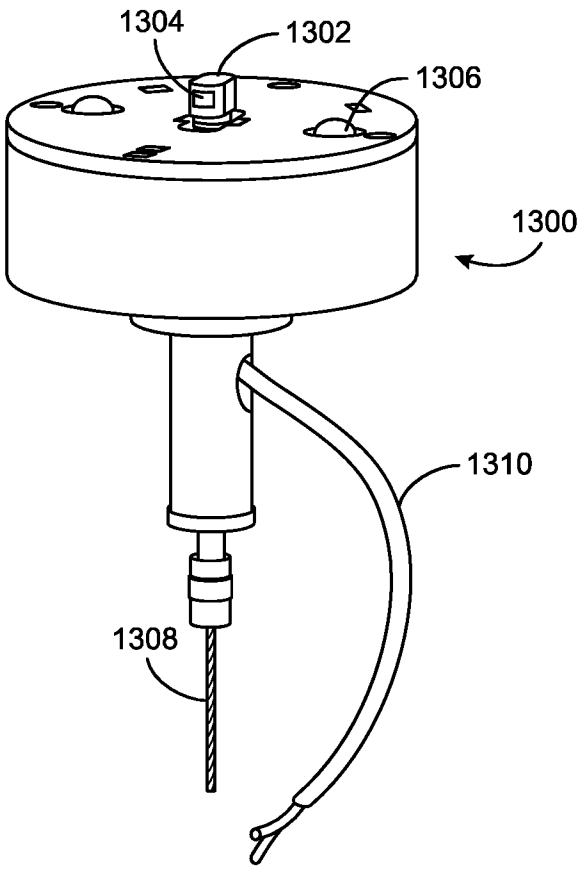
FIG. 13 illustrates a yet further example connector.

Turning to FIGS. 13 and 14, a further exemplary connector 1300, having a housing for housing the PCB 23, which is adapted to be releasably connected to the underside of the bus bar 12 is illustrated. To this end, the connector 1300 includes an oblong shaped protuberance 1302 having electrical contacts 1304 for engaging with corresponding electrical conductors that are carried within a channel 13 of the bus bar 12. Thus, to connect the connector 1300, and accordingly the PCB 23, to the bus bar 12, the protuberance 1302 is aligned with and positioned within the channel 13 of the bus bar 12 and the connector 1300 is then twisted such that the underside of the ends located at the longest opposed sides of the protuberance 1302 rest upon corresponding channel rail edges 13A that are provide to the bus bar 12. When the connector 1300 is connected to the bus bar 12 in this manner, the electrical contacts 1304 will be placed into electrical contact with the power conductors 13B that are provided along the sides of the channel 13. To maintain the connector 1300 in this connected position, the connector 1300 may further be provided with seating elements 1306, which may take the form of spring biased, ball shaped elements as illustrated, where the seating elements 1306 are arranged to be positioned within the channel 13 when the connector 1300 is placed into electrical connection with the bus bar 12 with the seating elements 1306 then functioning to inhibit the connector 1300 from being twisted to a point where such electrical connection is lost. The connector 1300 further includes a wire or other element 1308 by which a load device, such as a lamp, is mechanically connected to, e.g., hung from, the connector 1300. The load device will also be electrically coupled to the connector 1300, and accordingly PCB 23, via use of wires 1310 as also illustrated.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

What is claimed is:

1. A connector for use in coupling a load device to electrical conductors of a direct current bus bar, comprising:

a first housing carrying a first electrical contact element for electrically coupling to a first electrical conductor of the bus bar; and a second housing coupled to the first housing and carrying a second electrical contact element for electrically coupling to a second electrical conductor of the bus bar, wherein the first housing is pivotally coupled to the second housing; and a printed circuit board contained at least partially within the second housing, the printed circuit board being coupled to the first electrical contact element and the second electrical contact element and comprising a processing device configured to provide direct current power from the bus bar to the load device.

2. The connector as recited in claim 1, wherein the printed circuit board is further electrically connected to a source of emergency direct current power and wherein the processing device is further configured to cause the connector to provide direct current power from the emergency direct current power source to the device in an absence of direct current power being provided from the bus bar.

3. The connector as recited in claim 2, wherein the processing device is further configured to cause the connector to use pulse width modulation to dim the direct current power being provided to the device from the bus bar.

4. The connector as recited in claim 1, wherein the processing device is further configured to cause the connector to use pulse width modulation to dim the direct current power being provided to the device from the bus bar.

5. The connector as recited in claim 1, wherein the processing device is further configured to cause the connector to provide a dimming control signal to the device.

6. The connector as recited in claim 1, wherein the processing device is further configured to cause the connector to provide a dimming control signal, having a data representative of a value from 0-10, to the device.

7. The connector as recited in claim 1, wherein the processing device is further configured to cause the connector to provide a digital addressable lighting interface (DALI) protocol signal to the device.

8. A connector for use in coupling a load device to electrical conductors of a direct current bus bar, comprising:

a first housing and a second housing, wherein the first housing is pivotally coupled to the second housing such that the connector is configured to be releasably coupled to the bus bar, the connector having a line-side interface arranged for electrically coupling the connector to the electrical conductors of the bus bar, a load-side interface arranged for electrically coupling the connector to the load device, a printed circuit board contained at least partially within the first housing and electrically coupled to the line-side interface and the load-side interface and comprising a processing device configured to control a bringing of power to the load-side interface from the line-side interface, and an RF receiver coupled to the printed circuit board for receiving a first signal from a device external to the connector, wherein the RF receiver responds to receiving the first signal by providing a second signal to the processing device and the processing device responds to receiving the second signal by causing the power to be brought from the line-side interface to the load-side interface.

9. The connector as recited in claim 8, wherein the first housing and the second housing are configured to be releasably attached within a channel of the bus bar.

10. The connector as recited in claim 8, wherein the first housing and the second housing are configured to be releasably positioned around the bus bar.

11. The connector as recited in claim 8, wherein the processing device is further configured to cause the connector to control a bringing of power to the load-side interface from the line-side interface by transmitting an on/off power controller signal to the load device.

12. The connector as recited in claim 8, wherein the processing device is further configured to cause the connector to control a bringing of power to the load-side interface from the line-side interface by transmitting a dimming power controller signal to the load device.

13. The connector as recited in claim 12, wherein the load device comprises a dedicated interface element for use transmitting the dimming power controller signal to the load device.

14. The connector as recited in claim 8, wherein the processing device is further configured to cause the connector to control a bringing of power to the load-side interface from the line-side interface by transmitting a dimming control signal having a data representative of a value from 0-10 to the load device.

15. The connector as recited in claim 8, wherein the processing device is further configured to cause the connector to control a bringing of power to the load-side interface from the line-side interface by transmitting a digital addressable lighting interface (DALI) protocol signal to the load device.

16. The connector as recited in claim 8, wherein the connector comprises a further interface for coupling the printed circuit board to a source emergency direct current power and wherein the processing device is further configured to cause the connector to provide direct current power from the emergency direct current power source to the load device in an absence of direct current power being provided from the bus bar.

17. A connector for use in coupling a load device to electrical conductors of a direct current bus bar, comprising:

a housing having a line-side interface having electrical contacts arranged for electrically coupling the connector to corresponding ones of the electrical conductors of the bus bar, a load-side power interface having one or more electrical contacts arranged for electrically coupling the connector to a one or more corresponding electrical conductors associated with the load device, a load-side control interface separate and distinct from the load-side power interface having one or more electrical contacts arranged for electrically coupling the connector to a one or more corresponding electrical conductors associated with the powered device, a printed circuit board electrically coupled to the line-side interface, the load-side power interface, and the load-side control interface, wherein the printed circuit board comprises a processing device configured to one of couple the load-side power interface to the line-side interface to thereby control the providing of power from the bus bar to the powered device via the one or more corresponding electrical conductors associated with the powered device and the one or more electrical contacts of the load-side power interface and provide a dimming control signal to the powered device via the one or more corresponding electrical conductors associated with the powered device and the one or more electrical contacts of the load-side control interface, and a receiver electrically coupled to the printed circuit board for receiving a first signal from a controlling device external to the connector and for generating, in response thereto, a second signal for provision to the printed circuit board whereby the processing device responds to receiving the second signal by one of coupling the load-side power interface to the line-side interface and provide the dimming control signal to the powered device.

18. The connector as recited in claim 17, wherein the processing device is further configured to cause the connector to provide a dimming control signal having a data representative of a value from 0-10.

19. The connector as recited in claim 17, the processing device is further configured to cause the connector to provide a digital addressable lighting interface (DALI) protocol dimming control signal.

20. The connector as recited in claim 17, wherein the connector comprises a further interface for coupling the printed circuit board to a source emergency direct current power and wherein the processing device is further configured to cause the connector to provide direct current power from the emergency direct current power source to the load device in an absence of direct current power being provided from the bus bar.

21. The connector as recited in claim 17, wherein the housing is adapted to be releasably attached within a channel of the bus bar.

22. The connector as recited in claim 17, wherein the housing is adapted to be releasably positioned around the bus bar.

* * * * *